US009643187B2

(12) United States Patent
Christoffersson

(10) Patent No.: US 9,643,187 B2
(45) Date of Patent: May 9, 2017

(54) GYRATORY CRUSHER TOPSHELL

(71) Applicant: SANDVIK INTELLECTUAL PROPERTY AB, Sandviken (SE)

(72) Inventor: Andreas Christoffersson, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/786,870

(22) PCT Filed: Apr. 25, 2013

(86) PCT No.: PCT/EP2013/058637
§ 371 (c)(1),
(2) Date: Oct. 23, 2015

(87) PCT Pub. No.: WO2014/173450
PCT Pub. Date: Oct. 30, 2014

(65) Prior Publication Data

US 2016/0067712 A1 Mar. 10, 2016

(51) Int. Cl.
*B02C 2/00* (2006.01)
*B02C 2/04* (2006.01)
*B02C 2/06* (2006.01)

(52) U.S. Cl.
CPC ..... *B02C 2/04* (2013.01); *B02C 2/047* (2013.01); *B02C 2/06* (2013.01)

(58) Field of Classification Search
CPC ..... B02C 2/04; B02C 2/06; B02C 2/047
USPC ..... 241/207, 209
See application file for complete search history.

(56) References Cited

U.S. PATENT DOCUMENTS

| | | | | |
|---|---|---|---|---|
| 2,509,920 | A | 5/1950 | Gruender | |
| 2,684,208 | A * | 7/1954 | Werner | B02C 2/045 241/207 |
| 5,163,213 | A * | 11/1992 | Brizendine | B02C 2/045 241/215 |
| 5,769,340 | A | 6/1998 | Jean | |
| 5,915,638 | A | 6/1999 | Jean | |
| 6,007,009 | A | 12/1999 | Sheridan et al. | |
| 6,536,693 | B2 | 3/2003 | Mullem | |
| 2007/0272780 | A1 | 11/2007 | Olsson et al. | |
| 2009/0008489 | A1 | 1/2009 | Nieminen | |
| 2010/0270409 | A1 * | 10/2010 | Eriksson | B02C 2/005 241/207 |

FOREIGN PATENT DOCUMENTS

| | | | |
|---|---|---|---|
| CN | 2297243 | Y | 11/1998 |
| CN | 102387866 | A | 3/2012 |
| GB | 566840 | A | 1/1945 |
| GB | 1570015 | A | 6/1980 |
| JP | 2004136252 | A | 5/2004 |

(Continued)

*Primary Examiner* — Faye Francis
(74) *Attorney, Agent, or Firm* — Corinne R. Gorski

(57) ABSTRACT

A gyratory crusher topshell and topshell assembly including an outer crushing shell and optional intermediate spacer ring. The topshell has a radially inward facing surface that is divided into a plurality of regions including an upper and lower mount region axially separated by an intermediate annular rib. The rib enables the topshell to be compatible with a variety of different sized and shaped concaves optionally using an intermediate spacer ring without the need for a backing compound.

7 Claims, 10 Drawing Sheets

(56) References Cited

FOREIGN PATENT DOCUMENTS

| | | | |
|---|---|---|---|
| WO | 2004/110626 | | 12/2004 |
| WO | 2008140375 | A1 | 11/2008 |
| WO | 2010123431 | A1 | 10/2010 |
| WO | 2012005651 | A1 | 1/2012 |

* cited by examiner

GYRATORY CRUSHER TOPSHELL

RELATED APPLICATION DATA

This application is a §371 National Stage Application of PCT International Application No. PCT/EP2013/058637 filed Apr. 25, 2013.

FIELD OF INVENTION

The present invention relates to a gyratory crusher frame part and in particular although not exclusively, to a topshell having a plurality of radially inward facing mount surfaces or regions to positionally support a radially inner spacer ring and/or different types and sizes of crushing shells.

BACKGROUND ART

Gyratory crushers are used for crushing ore, mineral and rock material to smaller sizes. Typically, the crusher comprises a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Example gyratory crushers are described in WO 2008/140375, WO 2010/123431, US 2009/0008489, GB 1570015, U.S. Pat. No. 6,536,693, JP 2004-136252, U.S. Pat. No. 1,791,584 and WO 2012/005651.

Primary crushers are heavy-duty machines designed to process large material sizes of the order of one meter. Secondary and tertiary crushers are however intended to process relatively smaller feed materials typically of a size less than 35 centimetres. Cone crushers represent a sub-category of gyratory crushers and may be utilised as downstream crushers due to their high reduction ratios and low wear rates.

Typically, a spacer (or filler) ring is used to accommodate different geometries of different concaves and in particular to adapt the same topshell for mounting medium or fine sized concaves used in secondary and tertiary crushers in contrast to the much larger diameter coarse concaves that fit directly against the topshell and have a maximum diameter to receive large objects for crushing. WO 2004/110626 discloses a gyratory crusher topshell having a plurality of different spacer ring embodiments for mounting a variety of different concaves at the crushing region.

Typically, both the inner and outer crushing shells wear and distort due to the significant pressures and impact loading forces they transmit. In particular, it is common to use backing compounds to structurally reinforce the outer shell and assist with contact between the radially outward facing surface of the outer shell and the radially inward facing surface of the topshell. It is also typical to employ a backing compound at a region around the spacer ring for additional structural reinforcement and to ensure the various components mated together correctly. Example backing compounds include Korrobond 65™ and 90™ are available from ITW ('Korroflex') Ltd, Birkshaw UK; and Krush-More™ from Monach Industrial Products (I) Pvt., Ltd, India.

However, the majority of widely used backing compounds are disadvantageous for health and environmental reasons and require long curing times that extend the downtime of the crusher. Accordingly, there is a general preference to avoid their use. There is therefore a need for a gyratory crusher frame part that reduces or eliminates the requirement for use of backing compounds at the concave and filler ring regions.

SUMMARY OF THE INVENTION

It is an objective of the present invention to provide a gyratory crusher frame part and in particular, although not exclusively, a crusher topshell that is compatible for use with outer crushing shells (concaves) of various different sizes and shapes and does not require a backing compound that would otherwise be needed to provide correct alignment of the crushing shell and additional structural reinforcement. It is a further objective to provide a topshell that is configured to support directly an intermediate spacer ring for use with medium and fine outer crushing shells that eliminates or minimises the need for a backing compound at the region of the spacer ring.

The objectives are achieved by providing a topshell having a plurality of mounting regions and surfaces that are both axially and radially separated from one another to provide different regions of contact for the outer crushing shell and/or spacer ring. The relative positioning, size, geometry and orientation of the mounting regions and surfaces of the topshell are configured to provide different points of contact with the radially inner positioned component i.e., concave and/or spacer ring. Additionally, the present mounting and support regions of the topshell are configured to allow convenient installation of the concave and/or filler ring within the internal chamber (as defined by the topshell) so as to minimise downtime of the crusher during maintenance or crusher setting changes.

In particular, the present topshell advantageously comprises first and second mount regions axially separated from one another and having an annular rib positioned axially intermediate the mount regions and projecting radially inward from an inner region of the wall of the topshell. Such a configuration provides an annular protrusion that is capable of being contacted by a radially outward facing engaging region of a relatively large internal diameter 'coarse' concave to represent a third contact region. The coarse concave is in turn radially supported by the annular rib to reduce or eliminate the need for an intermediate backing compound to fill the region between the topshell and the concave.

The annular rib is positioned and dimensioned so as to not interfere with the alternate configuration of the topshell when used with an intermediate spacer ring to mount relatively smaller internal diameter medium or fine concaves.

According to a first aspect of the present invention there is provided a gyratory crusher frame part comprising: a topshell having an annular wall extending around a longitudinal axis of the frame part, the wall being defined radially between a radially outward facing surface and a radially inward facing surface relative to the axis; a first and second mount region of the inward facing surface being inclined relative to the axis such that respective first axial upper ends of the first and second mount regions are positioned radially closer to the axis than respective second axially lower ends, the second mount region positioned axially lower than the first mount region, wherein a part of the first mount region projects radially inward of a part of the second mount region; characterised by: an annular rib positioned axially between the first and second mount regions and projecting radially inward from the wall, the annular rib having an inward facing mount surface positioned radially inward relative to the axially lower end of the first mount region and the axially upper end of the second mount region.

Optionally, the mount surface is less inclined than the inward facing surface at the first and second mount regions. Preferably, the mount surface is substantially parallel with the longitudinal axis.

Optionally, the inward facing surface comprises curved transition sections positioned axially between the mount surface and the respective first and second mount regions. Optionally, the inward facing surface at the transition sections may be chamfered or straight. Preferably, the axially upper end of the first mount region is positioned radially inward of the mount surface.

Optionally, an axial length of the mount surface is less than an axial length of each of the first and second mount regions. Optionally, the inward facing surface at the first and second mount regions are coplanar.

According to a second aspect of the present invention there is provided a gyratory crusher comprising: a topshell as described and claimed herein; and a crushing shell positioned radially inward of the topshell wall, the crushing shell comprising: an annular main body mountable within a region of the topshell, the main body extending around the longitudinal axis; the main body having a mating surface being outward facing relative to the axis for positioning opposed to at least a part of the topshell and a crushing surface being inward facing relative to the axis to contact material to be crushed, at least one wall defined by and extending radially between the mating surface and the crushing surface, the wall having a first upper axial end and a second lower axial end; a raised first contact region positioned axially towards the first upper axial end and extending radially outward relative to the mating surface and in a direction around the axis, the contact region having a radially outward facing raised first contact surface for positioning opposed to the inward facing surface of the topshell; a raised second contact region positioned axially towards the second lower axial end and extending radially outward relative to the mating surface in a direction around the axis, the second contact region having a radially outward facing raised second contact surface for positioning opposed to the inward facing surface of the topshell; and an annular groove extending around the axis and recessed radially inward relative to the first and second contact regions to axially separate the first and second contact regions.

According to a further aspect of the present invention there is provided a gyratory crusher comprising: a topshell as described and claimed herein; and a spacer ring positioned radially inward of the topshell to positionally support a crushing shell at the topshell, the spacer ring comprising: a generally annular main body extending around the axis and having an axially upper end positioned uppermost within the crusher and an axially lower end positioned lowermost in the crusher relative to the upper end, the main body further having a radially inward facing surface and a radially outward facing surface; a first mount portion of the outward facing surface being inclined relative to the axis and mated against the first mount region of the topshell; a second mount portion of the outward facing surface being inclined relative to the axis and mated against the second mount region of the topshell; an annular channel extending axially between the first and second mount portions and projecting radially inward relative to the first and second mount portions; and an annular shoulder positioned axially between the first and second mount portions and projecting radially inward from the main body, the shoulder having an inward facing support surface representing a radially innermost part of the spacer ring relative to the axis.

Preferably, the spacer ring further comprises at least one bore hole extending through the main body (wall) of the ring from the outward to the inward facing surface. Preferably the hole is positioned axially above the annular rib.

Preferably, the support surface is aligned substantially parallel with the axis. Preferably, the first and second mount portions are substantially coplanar. Preferably, an axial length of the contact surface of the raised first contact region of the crushing shell is greater than a corresponding axial length of the mount surface of the annular rib or support surface of the annular shoulder at the spacer ring. Advantageously, this configuration avoids any possible indentations in the topshell or spacer ring mating surfaces.

Optionally, the annular rib is accommodated radially within the annular channel. Preferably, the crusher further comprises a radial gap between the mount surface of the annular rib and a radially innermost region of the channel of the spacer ring.

Preferably, the crusher further comprises a crushing shell positioned radially inward of the spacer ring, the crushing shell comprising: a generally annular main body mountable within a region of the topshell and extending around the axis; the main body having a mating surface being outward facing relative to the axis for positioning opposed to at least a part of the topshell and the spacer ring and a crushing surface being inward facing relative to the axis to contact material to be crushed, at least one wall defined by and extending radially between the mating surface and the crushing surface, the wall having a first upper axial end and a second lower axial end; a raised first contact region positioned axially towards the first upper axial end and extending radially outward from the wall and in a direction around the axis, the contact region having a radially outward facing raised first contact surface for positioning opposed to the inward facing support surface of the spacer ring; a raised second contact region positioned axially towards the second lower axial end and extending radially outward from the wall and in a direction around the axis, the second contact region having a radially outward facing raised second contact surface for positioning opposed to the inward facing surface of the topshell at an axially lower region; and an annular groove extending around the axis and recessed radially inward relative to the first and second contact regions to axially separate the first and second contact regions.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
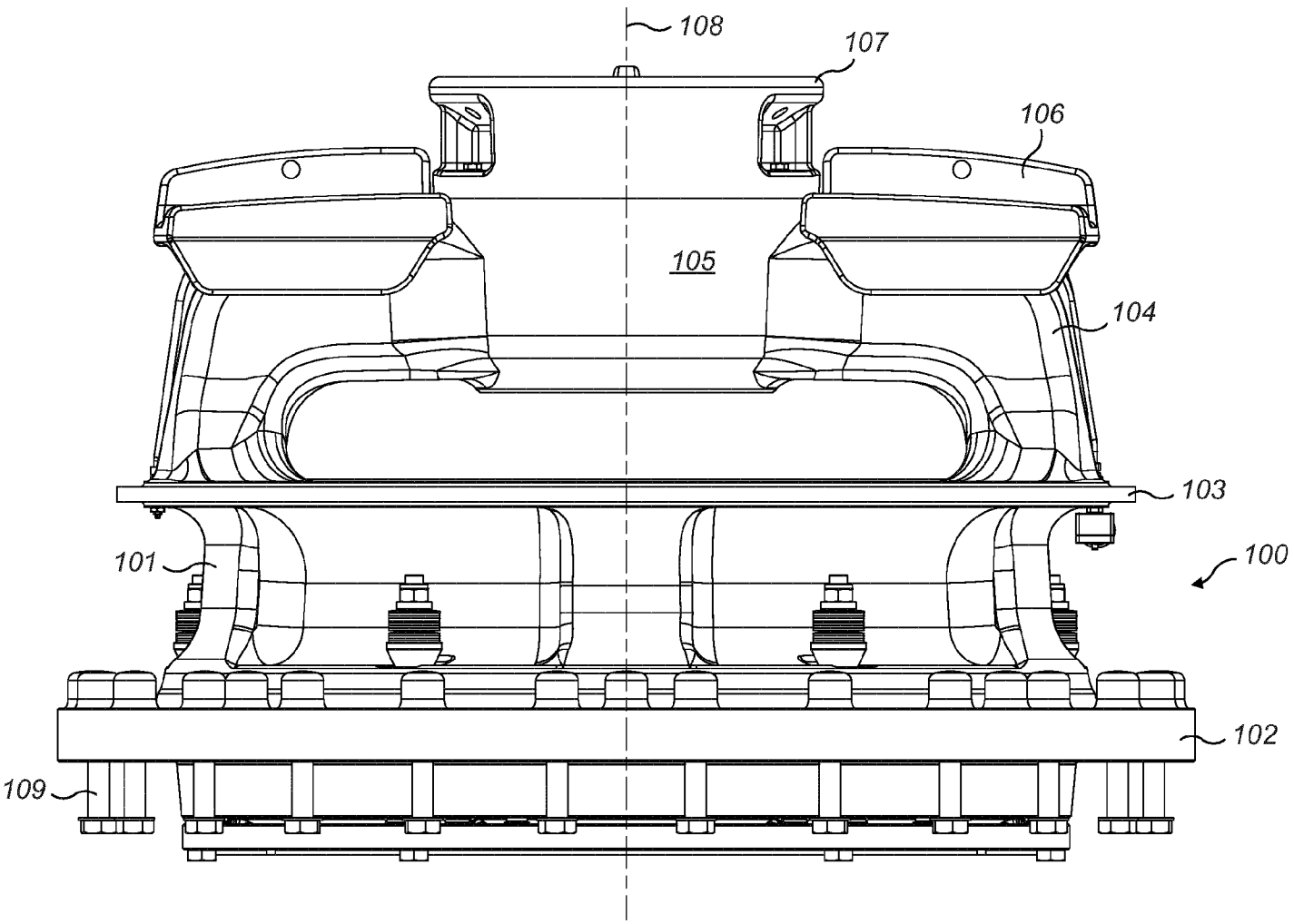
FIG. 1 is an external side elevation view of a topshell frame part of a gyratory crusher according to a specific implementation of the present invention.
Figure 2:
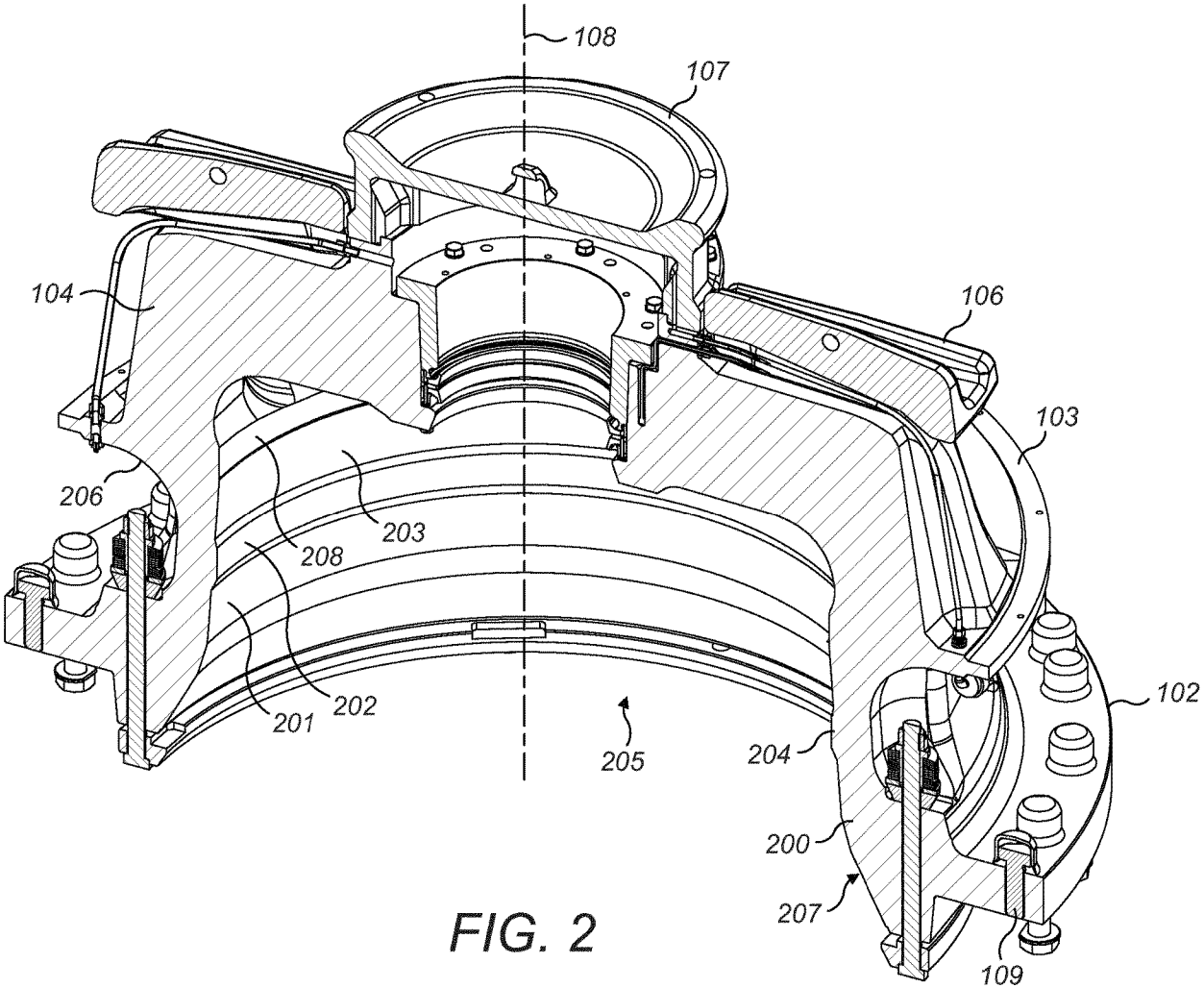
FIG. 2 is a perspective cross sectional view of the topshell of FIG. 1.
Figure 3:
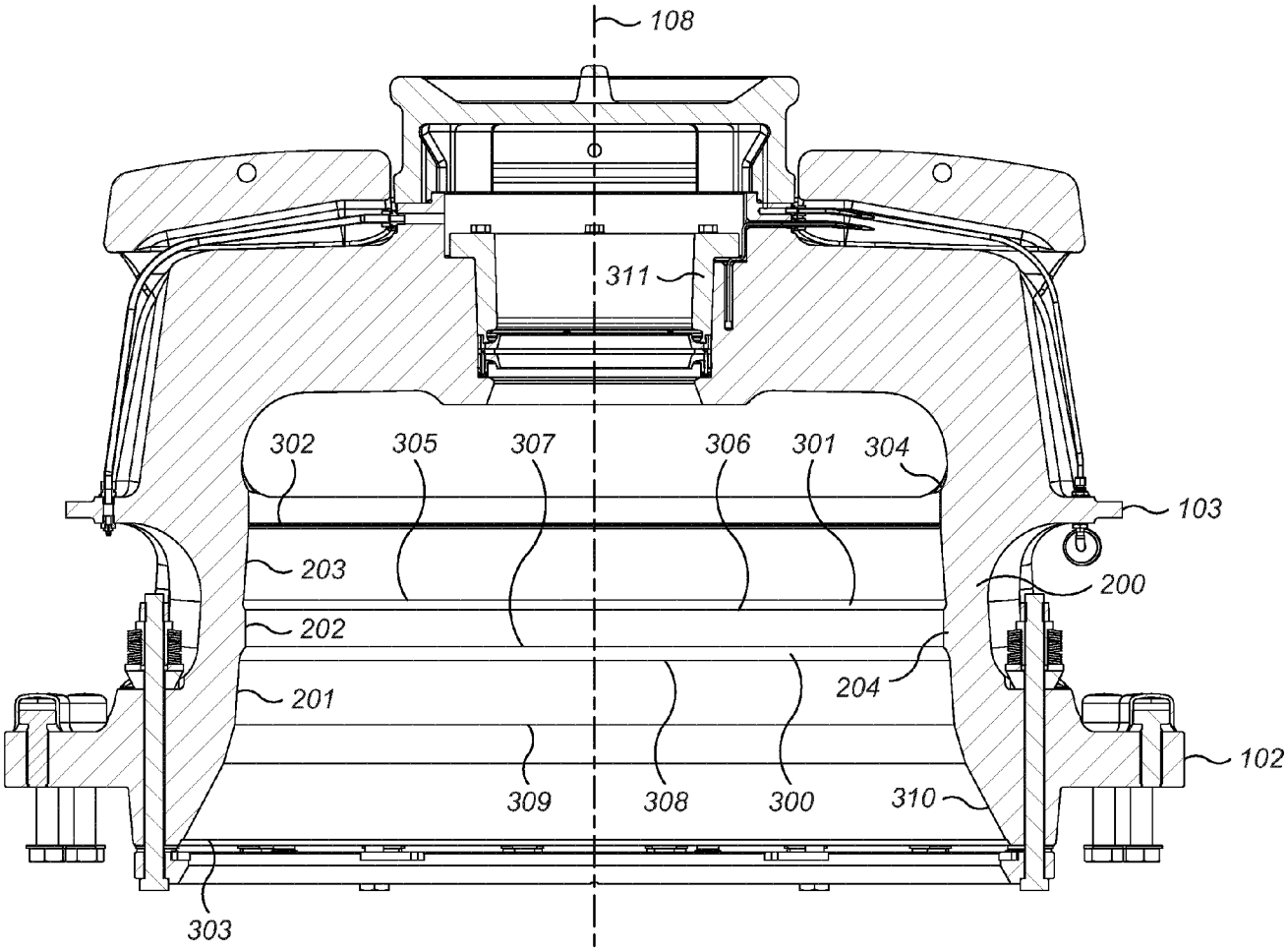
FIG. 3 is a side elevation cross sectional view of the topshell of FIG. 2.

Referring to FIGS. 1 to 3, a gyratory crusher comprises a frame comprising a topshell 100 forming an upper part of the crusher and mountable upon a bottom shell (not shown) such that the topshell 100 and bottom shell together define an internal chamber. A crushing head (not shown) is mounted on an elongate main shaft (not shown) extending through the crusher in the direction of longitudinal axis 108. A drive (not shown) is coupled to the main shaft and is configured to rotate eccentrically about axis 108 via a suitable gearing (not shown) to cause the crushing head to perform a gyratory pendulum movement and to crush material introduced into the crushing chamber. An upper end region of the main shaft is maintained in an axially rotatable position by a top-end bearing assembly 311 accommodated within a central boss 105. Similarly, a bottom end of the main shaft is supported by a bottom-end bearing assembly (not shown) accommodated below the bottom shell.

Topshell 100 is divided into a chamber wall region 101 extending axially between a lower annular rim 102 and an upper annular rim 103. Topshell 100 is secured to the bottom shell via rim 102 and mounting bolts 109. A spider forms an upper region of topshell 100 and is positioned axially above rim 103. The spider comprises a pair of spider arms 104 that project radially outward from central boss 105 to terminate at their radially outermost end at rim 103. Shields 106 are secured over the arms 104 at diametrically opposed sides of boss 105. A spider cap 107 sits on top of boss 105 between shields 106.

Topshell wall region 101 comprises topshell walls 200 defined between a radially inward facing surface indicated generally by reference 207 and a radially outward facing surface 206 relative to axis 108. Inward facing surface 207 defines an internal chamber 205 through which material to be crushed is fed via an input hopper (not shown) mounted generally above topshell 100 via rim 103. Inward facing surface 207 may be divided into a plurality of annular circumferential regions in the axial direction between a first upper end 304 and second lower end 303 of topshell wall 200. A first upper mount region 203 is positioned axially closer to top end 302 and a second lower mount region 201 is positioned axially closer to bottom end 303. The first and second mount regions 203, 201 are separated axially by an intermediate annular rib 204 that projects radially inward from wall 200 towards axis 108. The first and second mount regions 203, 201 are also coplanar and are orientated to be inclined relative to axis 108 such that an axially upper end 302 of first mount region 203 and an axially upper end 308 of second mount region 201 are positioned radially closer to axis 108 relative to respective second lower ends 305, 309 of each mount region 203, 201. A junction between annular rib 204 and the upper mount region 203 and lower mount region 201 comprises respective curved transitions 301 and 300. Each curved transition 301, 300 is terminated at the region of rib 204 by a respective annular upper edge 306 and lower edge 307. The axial separation of edges 306, 307 defines an annular radially inward facing mount surface 202 positioned axially between the inward facing surface 207 at upper and lower regions 203, 201. Mount surface 202 is aligned substantially parallel with axis 108 and is therefore aligned transverse to surfaces 203 and 201.

Rib 204 projects radially inward beyond both the lower end 305 of an upper mount region 203 and the upper end 308 of second lower mount region 201. Rib 204 therefore forms a radial abutment projecting inwardly into internal chamber 205 from the topshell wall 200 between upper and lower ends 304, 303. Rib 204 is positioned in the axially upper half of topshell 100 closest to upper end 304. An axially lowermost abutment region 310 is positioned axially below lower mount region 201 and extends axially upward from lower end 303. Abutment region 310 represents a region of inward facing surface 207 and is also inclined relative to axis 108 in a similar manner to upper and lower regions 203, 201. However, the angle of inclination of abutment region 310 is greater than regions 203 and 201.

According to the specific implementation, a diameter of topshell wall 200 at the inward facing surface 207 decreases from bottom end 303 to edge 307 of rib 204. The diameter is then uniform over the axial length of mount surface 202 to then decrease over transition region 301. The diameter at lower end 305 of upper mount region 203 is less than the diameter of mount surface 202. The diameter then increases in the axially upward direction from lower end 305 to upper end 302 of mount region 203 such that the upper end 302 comprises a diameter smaller than rib 204 and in particular mount surface 202.

Figure 4:
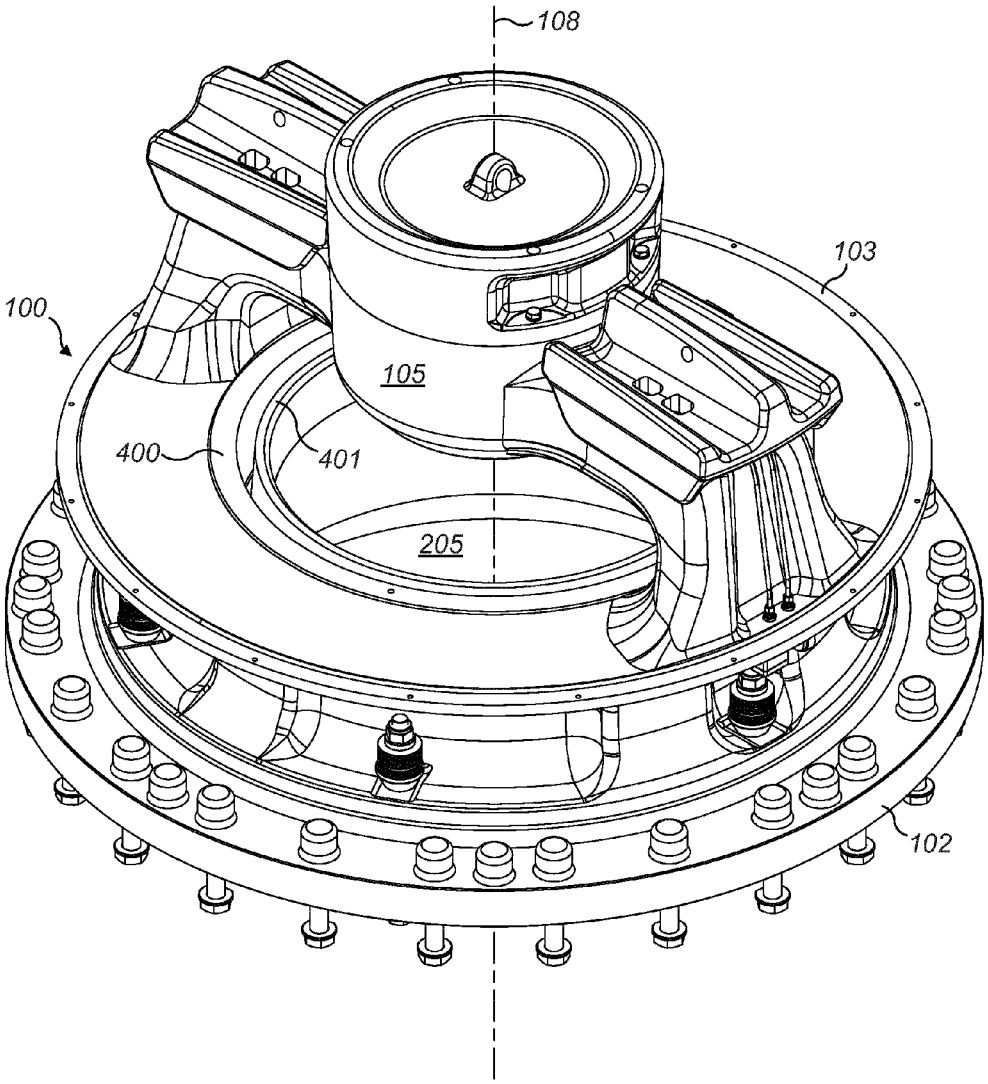
FIG. 4 is an upper perspective view of the topshell of FIG. 3 having an outer crushing shell positioned within an inner crushing chamber and a spacer ring positioned intermediate the topshell and the crushing shell according to a specific implementation of the present invention.
Figure 7:
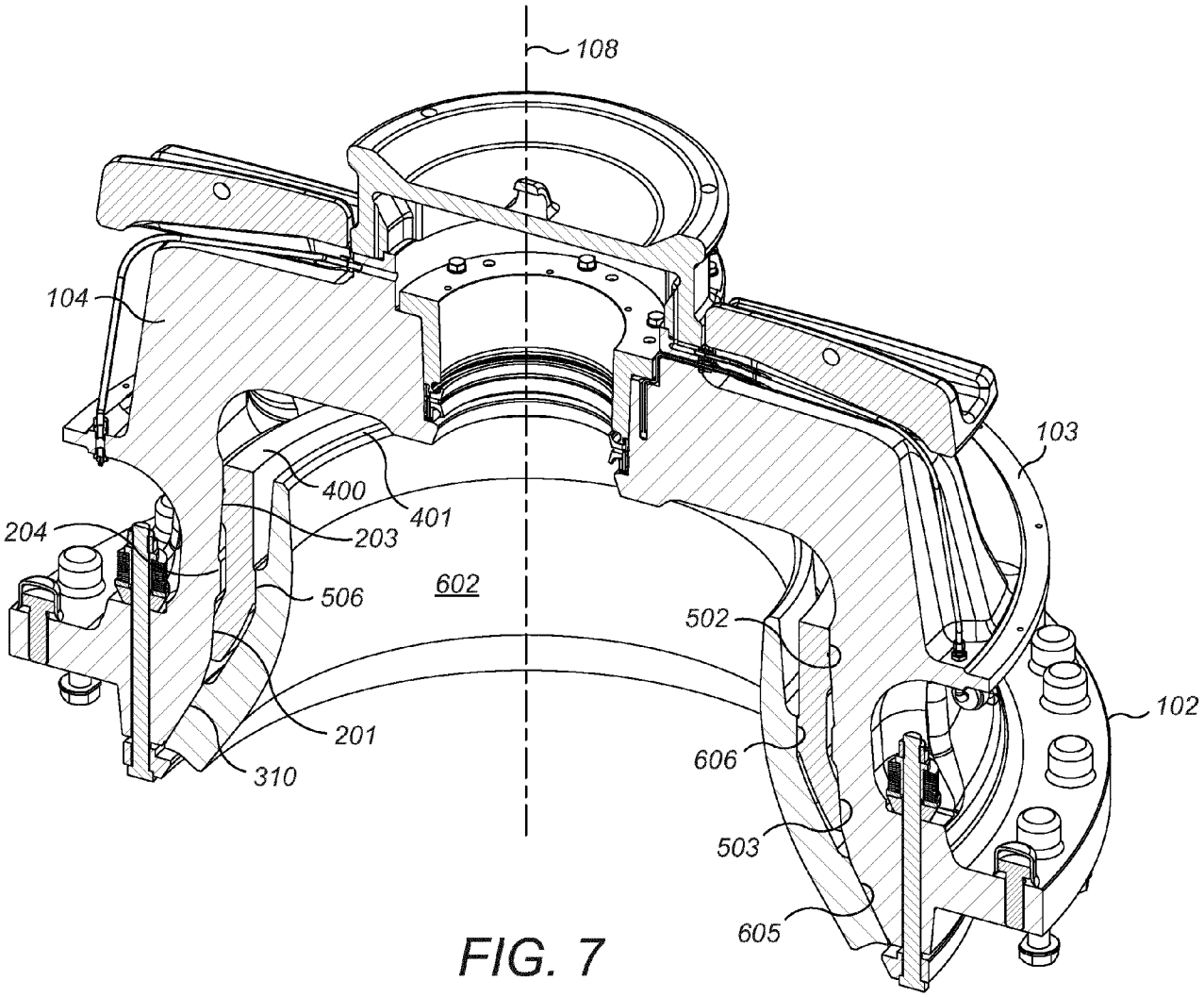
FIG. 7 is a cross sectional perspective view of the topshell of FIG. 4.
Figure 8:
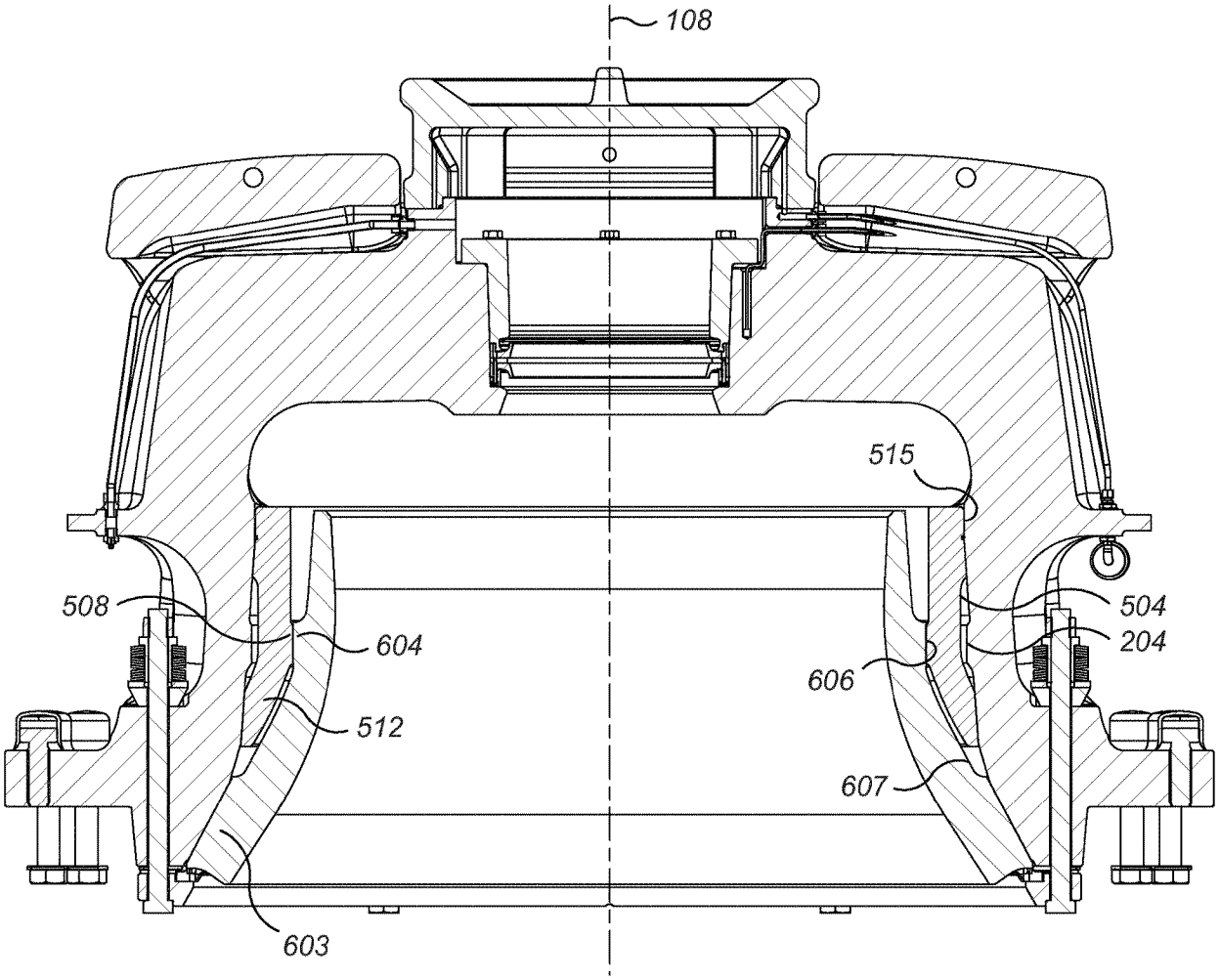
FIG. 8 is a side elevation cross sectional view of the topshell of FIG. 7.
Figure 10:
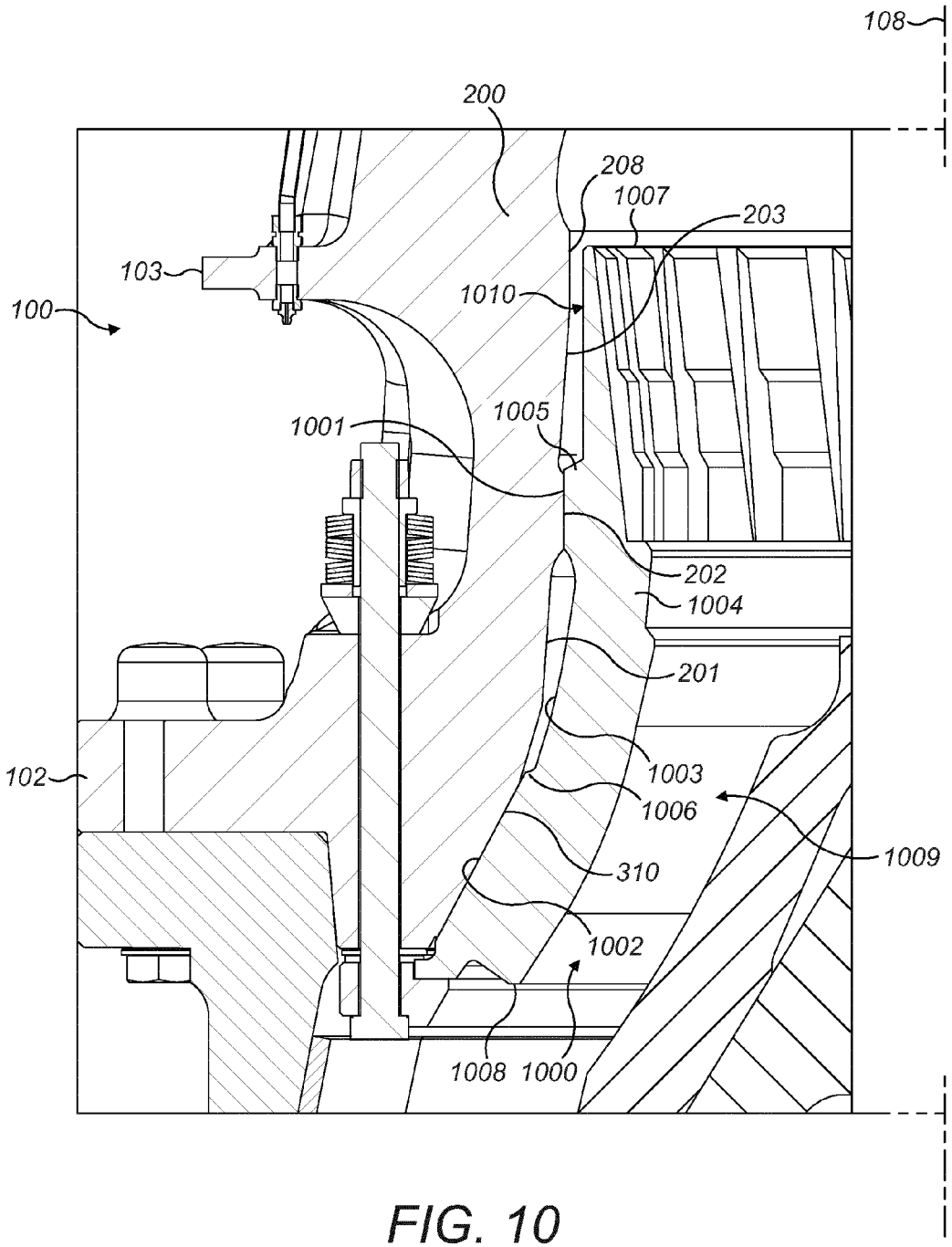
FIG. 10 is a side elevation cross sectional view of the topshell of FIG. 3 having a coarse outer crushing shell positioned in direct contact with the topshell wall between an upper and lower region within the crushing chamber according to a specific implementation of the present invention.

Topshell 100 via regions 310, 201, 203 and 204 is configured to accommodate and be operative with a plurality of different internally mounted components including outer crushing shells (concaves) and intermediate spacer (or filler) rings without requiring a backing compound of the type indicated above. However and optionally, a backing compound may be used with the present topshell configuration 100 if desired by an operator. That is, the topshell 100 may in one implementation accommodate a 'medium' or 'fine' grade concave 401 that is supported by a spacer ring 400 positioned radially intermediate concave 401 and topshell wall 200 as illustrated in FIGS. 4, 7 and 8. Additionally, topshell 100 is configured for use with a 'coarse' concave 1000 as illustrated in FIG. 10 positioned in direct contact with topshell wall 200 to enable the crushing of much larger and coarse crushable material.

Figure 5:
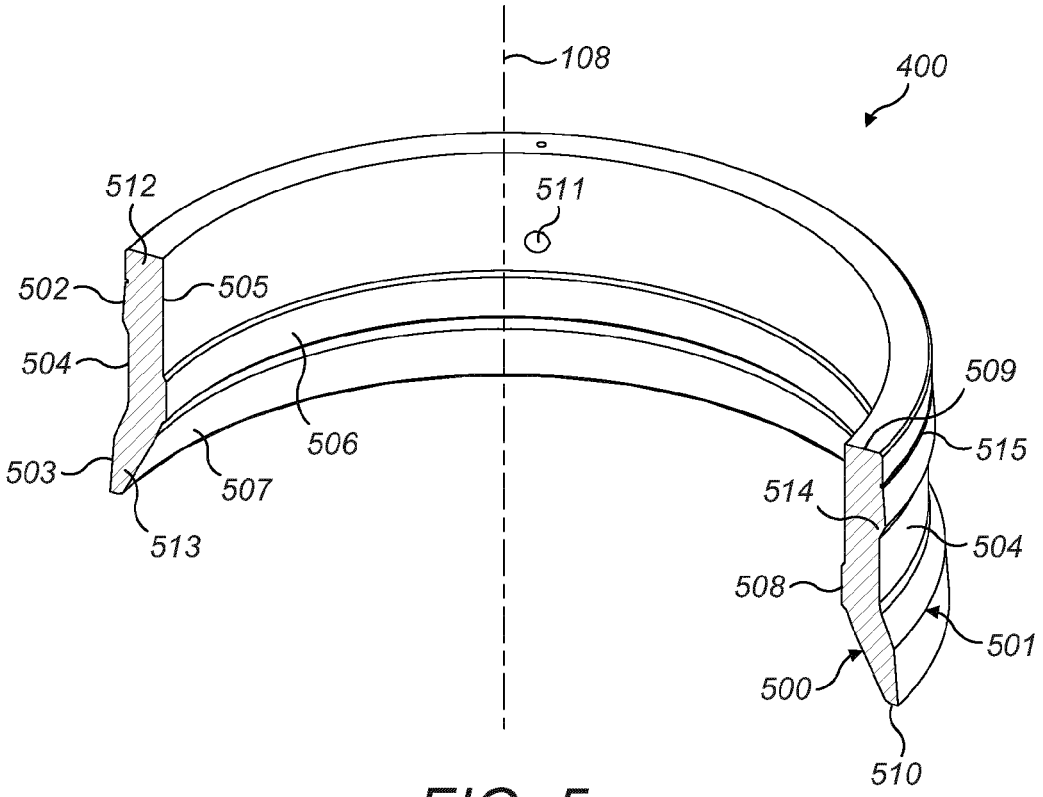
FIG. 5 is a cross sectional perspective view of the spacer ring of FIG. 4.

Referring to FIG. 5, top shell 100 comprises a generally annular body in which a radially inward facing surface, indicated generally by reference 500, and a radially outward facing surface, indicated generally by reference 501, define a generally cylindrical wall 512 having an upper end 509 and lower end 510. Wall 512 is divided into a plurality of regions in the axial direction 108. Inward facing surface 500 is divided into a first upper region 505 and a second lower region 507 separated axially by an intermediate annular shoulder 508 having a radially inward facing surface 506. Surface 506 is aligned substantially parallel with axis 108.

Similarly, upper region 505 comprises inward facing surface 500 being aligned substantially parallel with axis 108. The surface 500 at lower region 507 is inclined relative to axis 108. A first upper mount portion 514 projects radially outward from wall 512 and a second lower mount portion 513 also projects radially outward from wall 512. Accordingly, an annular channel 504 is formed between raised mount portions 514, 513 within the outward facing surface 501. An axial length of channel 504 is greater than the axial length of support surface 202. The outward facing surface 502, 503 at the respective upper and lower mount portions 514, 513 are coplanar and comprise respective axial lengths being slightly less than the axial length of the inward facing surfaces 203, 201 of topshell wall 200.

Two diametrically opposed boreholes 511 extend through wall 512 between the outward and inward facing surfaces 501, 500. Holes 511 allow backing material to be introduced (if desired) into the channel region 504 so as to fill the annular void between the spacer ring 400 and the topshell wall 200. As indicated, the use of a backing compound is entirely optional.

As illustrated in FIGS. 7 and 8, the radial depth of channel 504 is sufficient to accommodate annular rib 204 when ring 400 is positioned against inner topshell surface 207. In this configuration, outward facing surfaces 502 and 503 mate respectively against the opposed inward facing surfaces 203, 201. Close fitting contact is achieved as surfaces 502 and 503 are orientated to be inclined towards axis 108 at the same angle of inclination as surfaces 203 and 201. As illustrated, a small radial gap is created between a radially innermost region of channel 504 and mount surface 202 of rib 204.

To prevent contaminant dust and other materials passing into the axially lower region between ring 400 and topshell wall 200, an O-ring seal 515 is accommodated within a small annular groove formed within outward facing surface 502 at upper region 514. As illustrated in FIGS. 4 and 7, upper end 509 is positioned substantially coplanar with the top shell rim 103.

Figure 6:
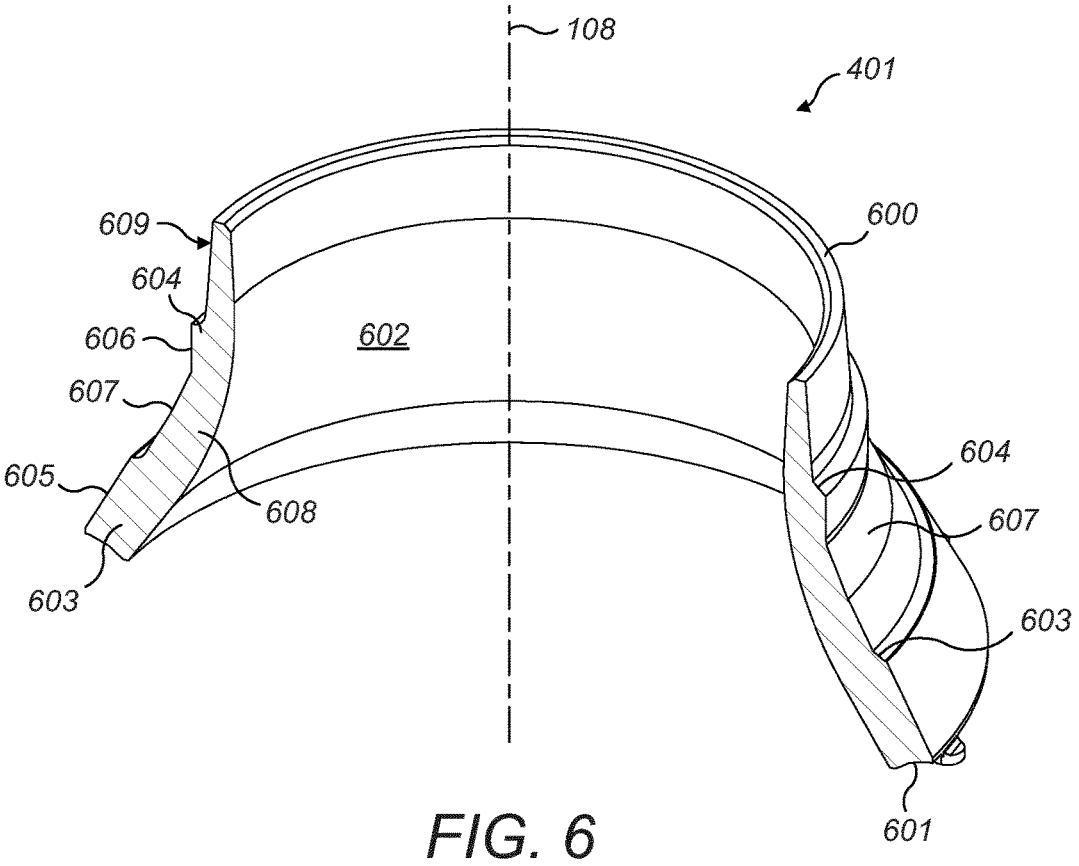
FIG. 6 is a cross sectional perspective view of the outer crushing shell of FIG. 4.

Referring to FIG. 6, concave 401 comprises a main body having an inward facing crushing surface 602 and an opposed radially outward facing mating surface indicated generally by reference 609 to define a wall 608 having a generally concave configuration at the region of the outward facing surface 609. Wall 608 comprises a first upper end 600 and an opposed second lower end 601. Wall 608 is divided into a plurality of regions in the axial direction 108 in which a raised first contact region 604 is axially separated from a raised second and lower contact region 603 by an axially intermediate annular groove 607. Region 604 is positioned in an axially upper half of concave 401 and region 603 is positioned in an axially lower half of concave 401. Region 604 comprises a radially outward facing contact surface 606 and region 603 comprises a corresponding radially outward facing contact surface 605. Upper contact surface 606 is aligned substantially parallel with axis 108 whilst lower contact surface 605 is inclined relative to axis 108 with an angle of inclination corresponding substantially to that of the inward facing surface of abutment region 310.

Figure 9:
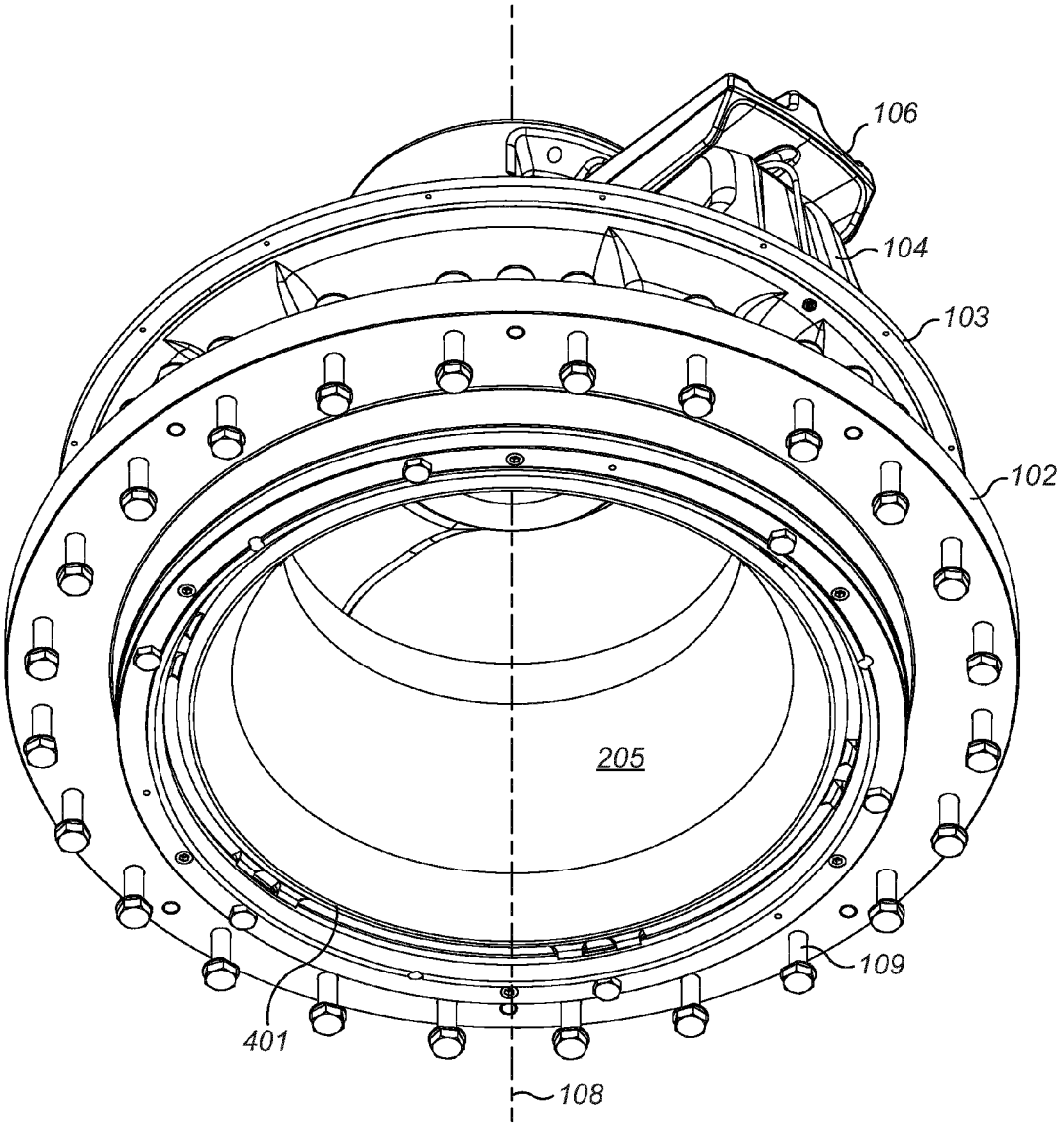
FIG. 9 is an underside perspective view of the topshell of FIG. 8.

Accordingly, and referring to FIGS. 7 to 9, concave 401 is accommodated within internal chamber 205 radially inward of spacer ring 400. In particular, ring 400 is positioned radially intermediate the axially upper two thirds of concave 401. Moreover, the lower contact surface 605 is positioned in direct contact against abutment region 310 whilst upper contact surface 606 is mated against support surface 506 of annular shoulder 508. Accordingly, an axially lower region of ring 400 is accommodated within annular groove 607 to enable concave 401 to be positioned in close fitting contact against ring 400 and topshell wall 200. The present profiled configuration of inward facing surface 207 at upper mount region 203 is advantageous to avoid the need for backing compound at the region between spacer ring 400 and topshell wall 200. This is achieved, in part, by the inclined surface profile of region 203 and the radial positioning of regions 203, 202 and 201 relative to one another.

Referring to FIG. 10, topshell 100 is equally compatible to accommodate a 'coarse' concave indicated generally by reference 1000. The coarse concave 1000 comprises a larger internal diameter relative to medium concave 401 and similarly comprises a main body having a wall 1004 extending between upper and lower ends 1007, 1008 respectively. Wall 1004 is defined by a radially inward facing surface indicated generally by reference 1009 and a radially outward facing surface indicated generally by reference 1010. Wall 1004 is divided axially into a plurality of regions including in particular a raised first contact region 1005 and raised second lower contact 1006. Regions 1005, 1006 project radially outward from wall 1004 and are separated by annular groove 1003 formed in the outward facing surface 1010. Upper region 1005 comprises radially outward facing contact surface 1001 and lower region 1006 comprises radially outward facing contact surface 1002. Surface 1002 is aligned transverse to axis 108 at an inclined angle substantially equal to the angle of inclination of surface 207 at lower abutment region 310 to allow surfaces 310 and 1002 to mate together in close touching contact. Contact surface 1001 is inclined substantially parallel with axis 108 to allow surface 1001 and mount surface 202 to mate together in close touching contact. That is, concave 1000 is positioned directly against topshell wall 200 via radial contact between the opposed radially inward projecting rib 204 and the radially outward projecting raised contact region 1005. Rib 204 provides contact with concave 1000 without requiring backing compound at this region. Additionally, rib 204 ensures radial clearance is provided between the upper region of the concave 1000 and topshell wall 200 (being in particular the region at and immediately below upper ends 1007, 304 respectively) so as to accommodate backing compound at this upper region if necessary.

The invention claimed is:

1. A gyratory crusher frame part comprising:

a topshell having an annular wall extending around a longitudinal axis of the frame part, the annular wall being defined radially between a radially outward facing surface and a radially inward facing surface relative to the longitudinal axis, the radially inward facing surface forming an internal chamber;

a first and a second mount region located in the internal chamber at the radially inward facing surface and being inclined relative to the longitudinal axis, the first and second mount regions each having an axial upper end and an axial lower end, such that the axial upper ends of the first and second mount regions are positioned radially closer to the longitudinal axis than the axial lower ends, the second mount region being positioned axially lower than the first mount region, wherein a part of the first mount region projects radially inward of a part of the second mount region; and an annular rib positioned axially between the first and second mount regions and projecting radially inward from the annular wall into the internal chamber, the annular rib having an inward facing mount surface positioned radially inward relative to the axial lower end of the first mount region and the axial upper end of the second mount region.

2. The frame part as claimed in claim 1, wherein the inward facing mount surface is less inclined than the radially inward facing surface at the first and second mount regions.

3. The frame part as claimed in claim 1, wherein the inward facing mount surface is substantially parallel with the longitudinal axis.

4. The frame part as claimed in claim 1, wherein the radially inward facing surface includes curved transition sections positioned axially between the inward facing mount surface and the first and second mount regions.

5. The frame part as claimed in claim 1, wherein the axial upper end of the first mount region is positioned radially inward of the inward facing mount surface.

6. The frame part as claimed in claim 1, wherein an axial length of the inward facing mount surface is less than an axial length of each of the first and second mount regions.

7. The frame part as claimed in claim 1, wherein the first and second mount regions are coplanar at the radially inward facing surface.

* * * * *